US005261478A

United States Patent [19]

Sun

[11] Patent Number: 5,261,478

[45] Date of Patent: Nov. 16, 1993

[54] ONE-BODY PRECISION CAST METAL WOOD AND PROCESS TO FORM SAME

[76] Inventor: Donald J. C. Sun, 4521 Ocean Valley La., San Diego, Calif. 92130

[21] Appl. No.: 2,271

[22] Filed: Jan. 8, 1993

Related U.S. Application Data

[63] Continuation-in-part of Ser. No. 844,757, Mar. 2, 1992, Pat. No. 5,219,408.

[51] Int. Cl.[5] ..... B22C 9/10; B22D 17/24

[52] U.S. Cl. ..... 164/137; 164/132; 273/167 H

[58] Field of Search ..... 164/369, 368, 366, 365, 164/346, 345, 132, 137; 273/171, 167 R, 167 A, 167 H, 173

[56] References Cited

U.S. PATENT DOCUMENTS 4,472,092 9/1984 Schmidt .
4,553,755 11/1985 Yamada .
4,651,799 3/1987 Chandley .
4,691,759 9/1987 Hayakawa et al. .
4,867,458 9/1989 Sumikawa et al. .
4,869,507 9/1989 Sahm .
4,951,731 8/1990 Downing .
5,033,530 7/1991 Egoshi et al. .

OTHER PUBLICATIONS

Pending U.S. Patent Application Serial No. 844,757 filed Mar. 2, 1992, Donald J. C. Sun, "One-Body Precision Cast Metal Wood".

*Primary Examiner*—Mark Rosenbaum
*Assistant Examiner*—Erik R. Puknys
*Attorney, Agent, or Firm*—William W. Haefliger

[57] ABSTRACT

The method of making a golf club head comprising a shell having a ball striking face, a top wall, a bottom wall, a rear wall, and toe and heel walls, the steps that include forming a head core consisting of a mixture of particles of sand or the like in a binder; providing a core arbor extending into the core and also externally thereof; and casting molten lightweight metal about the core and about the arbor to form the shell walls.

9 Claims, 3 Drawing Sheets

ONE-BODY PRECISION CAST METAL WOOD AND PROCESS TO FORM SAME

BACKGROUND OF THE INVENTION

This application is a continuation-in-part of Ser. No. 844,757, filed Mar. 2, 1992 now U.S. Pat. No. 5,219,408.

This invention relates generally to the making of golf club wood heads; and more particularly to making heads that consist of a lightweight metal shell with weight well distributed, and without any openings or metal inserts, surrounding a relatively heavy core.

Proper attention to die casting process control will result in consistently high quality irons. But one-body die cast metal woods are not successfully manufactured yet, since metal woods require a large interior hollow.

If a sand core is made to maintain its volume and shape during die casting, it cannot be removed or cleaned up from the inside of a one-body cast metal wood. The difficulty of one-body die casting of metal woods consists in how to make an effective core which is tough enough against high pressure and temperature in die casting and is yet also easily removed or cleaned up in post casting operations.

SUMMARY OF THE INVENTION

It is a major object of the invention to provide a solution to the above problems and difficulties.

In accordance with method aspects of the invention, the steps include a) forming a head core consisting of a mixture of particles of sand or the like in a binder, b) providing a core arbor extending into the core and also externally thereof, c) and casting molten lightweight metal about the core and about the arbor to form the shell walls.

As will be seen, the method typically includes providing mold sections about the core prior to the casting step, and causing at least one of the mold sections to extend about the arbor, externally of the core.

The method also includes forming an effective core, in which phenolic urethane resin or resins are used as a binder, the core being made tough enough to withstand high pressure and temperature in die casting, and is yet also easily removed from the metal shell, or cleaned up, in a post casting operation. The core arbor, placed in the sand core as a support bar as at the toe, acts to stabilize the sand core during the die casting process.

A further object is to provide one-body cast metal wood heads formed with precision weight distribution. Such one-body cast heads need no welding or screws to attach any parts such as inserts, and they are effective, economical and easy to produce.

Yet another object is to provide a golf club head as referred to, by means of the described improved method.

These and other objects and advantages of the invention, as well as the details of an illustrative embodiment, will be more fully understood from the following specification and drawings, in which:

DRAWING DESCRIPTION

DETAILED DESCRIPTION

Figure 7:
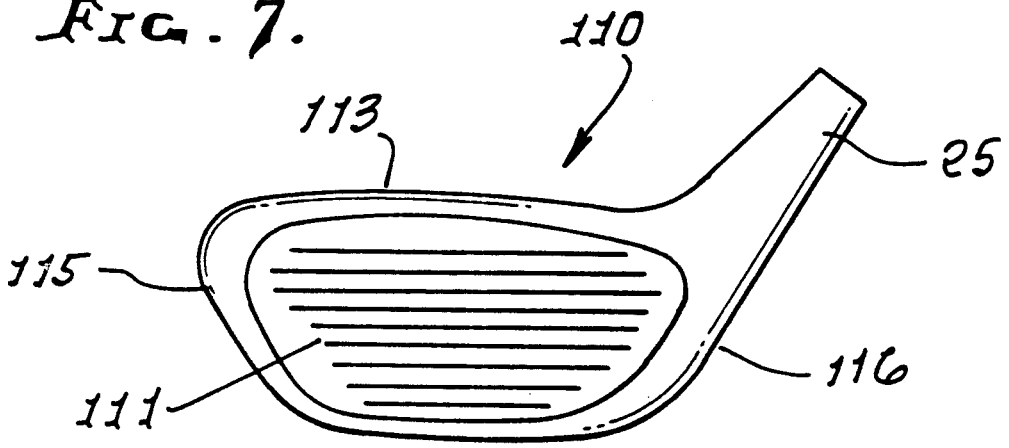
FIG. 7 is a frontal view of a molded head.
Figure 8:
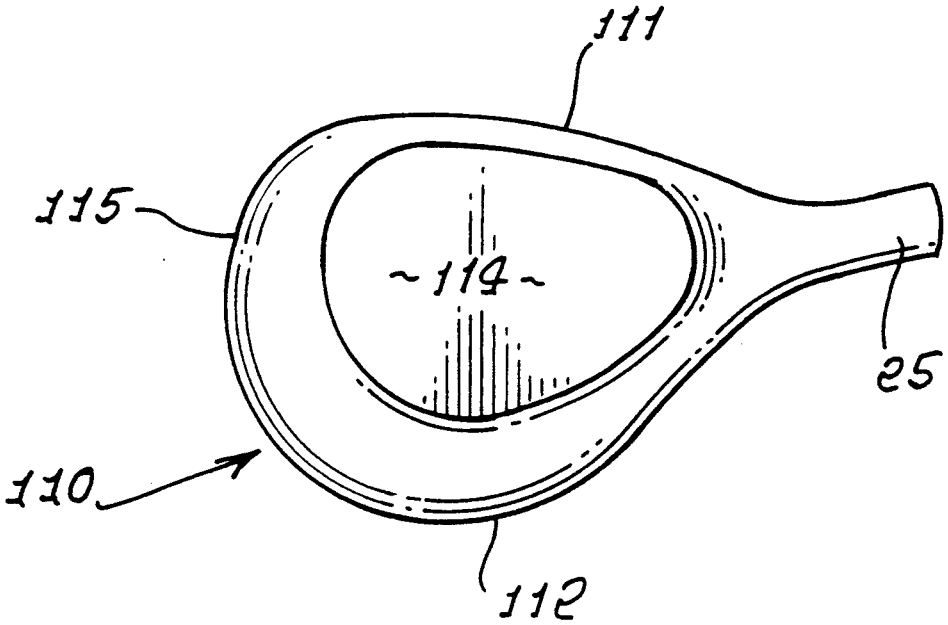
FIG. 8 is a bottom view of the FIG. 7 head.

In FIGS. 7 and 8, the golf club head 110 has a front wall 111, a rear wall 112, a top wall 113, a bottom wall 114, toe and heel walls 115 and 116, and a hosel 25. All head walls consist of well distributed lightweight metal, such as aluminum alloy, although other metals such as steel are contemplated.

Referring to FIGS. 1–4, an arbor bar is shown at 10 for supporting the sand core 11 within two core forming die sections 12 and 13. The bar and sections may consist of steel. The parting line between the sections appears at 14. The precision core front appears at 11*a*, corresponding to the inner side of the front wall 30*a* of the head 30 to be cast (see FIG. 6). The core rear appears at 11*b*, and corresponds to the inner side of the club head rear wall 30*b* to be cast. Being less critical, that rear side of the die sections forms an entry port 15 via which the mixture of core components (sand, binder, etc.) is conveyed into the core cavity seen at 16 in FIG. 2. Such conveying is typically carried out by blowing the mixture particles into the cavity, and about the arbor bar 10, to form and harden about that bar. See broken line 10*a* in FIG. 3 indicating that portion of the arbor encompassed by the hardened mix, and the full lines 10*b* in FIG. 3 indicating that portion of the arbor bar projecting outward or free of the core.

Figure 1:
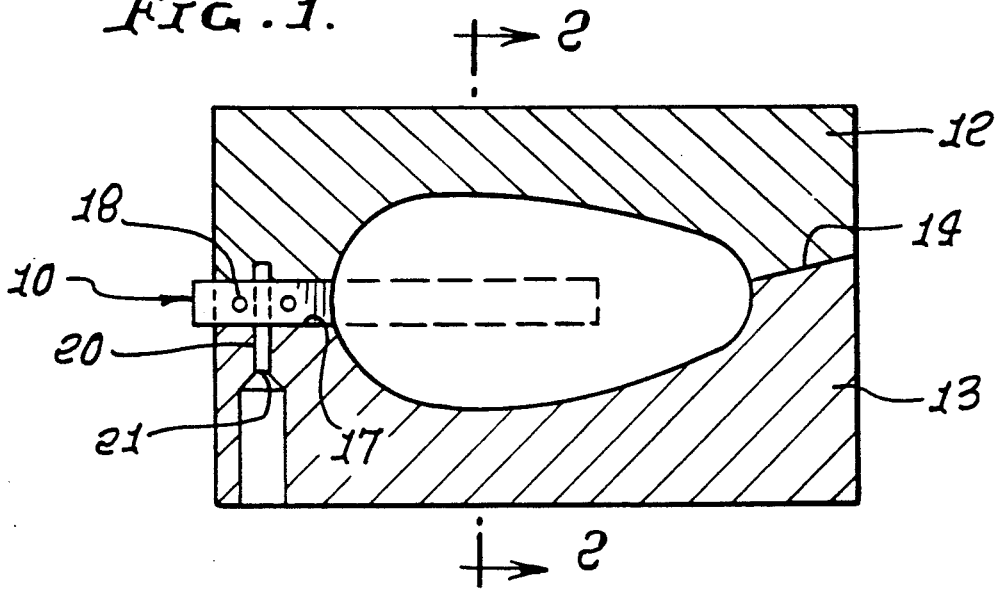
FIG. 1 is a vertical frontal section showing core forming die sections and a core stabilizing arbor.

Initially the bar portion 10*b* is rigidly supported in a slot 17 in die section 13 (see FIG. 1), as via connectors in holes 18 in the bar. A pin 20 may be inserted in a die opening 21, to releasably secure the arbor in position, as seen in FIG. 1. Subsequently, after the two die parts are clamped together, as at 22 in FIG. 2, the particulate composition that forms the core is blown into the cavity 16. Thereafter, the core material cures in situ to form a hardened core.

A sand/binder system based on phenolic urethane provides a multiplicity of operational advantages compared with alternative resin systems.

Phenolic urethane resins are used as a liquid catalyzed (no-bake) system. The phenolic urethane binder cures at room temperature and such cure is achieved after the catalyst is added to the sand/resin mixture.

Two liquid-resin components and a liquid catalyst comprise the system. The part I phenolformaldehyde resin is a clear, amber, organic polyol and the source of active hydroxyl groups (OH) necessary for bonding. The part II resin component is a dark liquid that provides active isocyanate groups (NCO) in the form of polymers of the MDI type (methylene bis phenylisocyanate). Binder levels ranging from 0.8 to 1.0% by weight are used to facilitate core clean-out. The two resins are normally used in offset proportions, such as 55/45 by weight of part I to 100 parts of part II.

Based on amine derivative developed catalyst, strip time ranges from 30 to 40 seconds. The tensile properties attainable with phenolic urethane binder are directly related to the binder percentage used.

Important considerations in selecting a sand are grain shape and distribution, incoming temperature, moisture content and surface chemistry. A typical white sand composition used for the core is as follows:

| $SiO_2$ | $Al_2O_3$ | MgO | CaO |
|---|---|---|---|
| 99.1 | 0.66 | 0.035 | 0.22 |

Using the above silica, tensile strengths are typically 225 to 325 psi, respectively, with 1.5% binder (based on sand). Cores can be produced in a one-minute cycle, i.e. much faster than prior processes requiring about five-minute cycles.

The pH for the sand should be between 6 and 7, for best core performance. The following binder ingredients are combined to achieve the sought results:

Phenolic resin (5110)

Isobutyro-nitrile acid (5230), 2%

Ammonia (used as a catalyst)

The weight parts of the ingredients are shown in the following table:

| Materials: | Sand (white) | Resin (5110) | Isobutyro-nitrile acid (5230) | Catalytic (ammonia) |
|---|---|---|---|---|
| Weights: | 100 g | 0.75 g | 0.75 g | 0.03 g |

Figure 2:
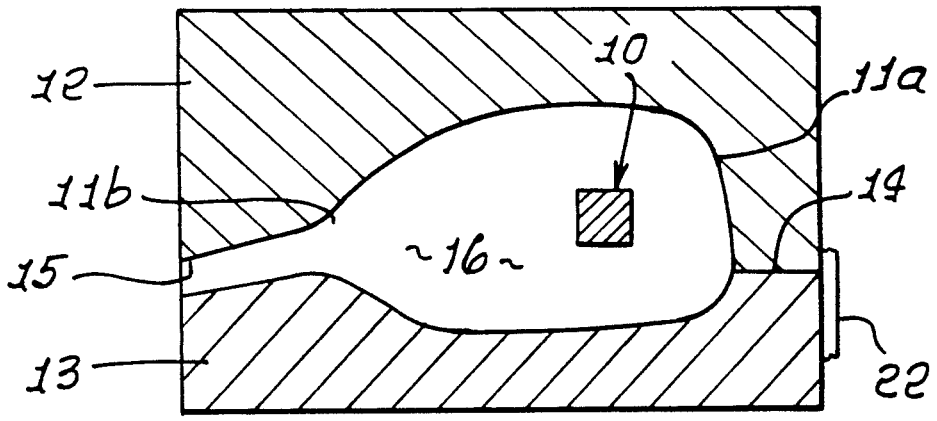
FIG. 2 is a section taken on lines 2—2 of FIG. 1.
Figure 3:
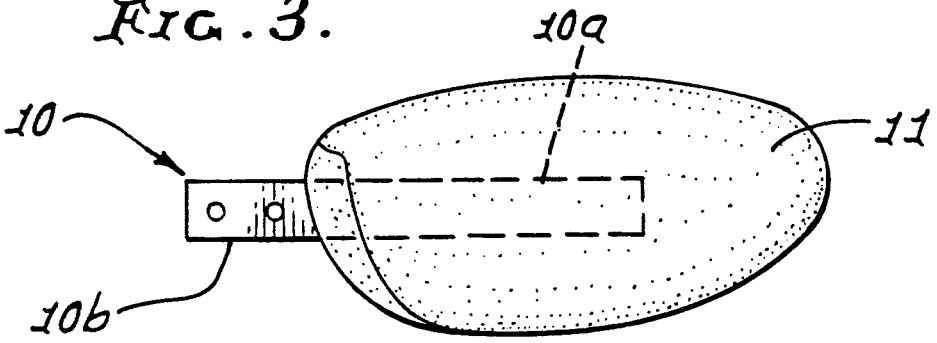
FIG. 3 is a side view showing a formed core supported on an arbor, after removal of the core from the core forming die sections.
Figure 4:
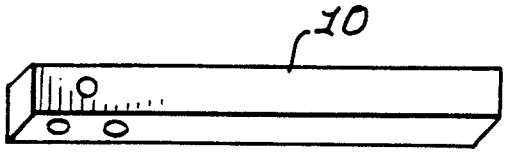
FIG. 4 is a perspective view of an arbor to support the core.

These ingredients are placed in a vessel and mixing of all ingredients is continued for 30 seconds. Sufficient mixture is then placed in a core mold as seen in FIGS. 1 and 2, to fill the mold hollow 16. After about one minute, the mold parts are separated, and the solidified core is removed. The core is then allowed to completely cure, for about 24 hours.

The core is then coated with a coating, as by dipping into a coating solution, at room temperature. One usable solution is known as "STYROMOL 169", produced by Foseco Japan Ltd. The coated core is then baked in a first oven for 30 minutes at about 150° C.; and then baked in a second oven at 230° for one hour, curing the coating. Such cured coating provides a barrier against penetration of hot die cast metal into the solidified sand core.

STYROMOL 169 is an insulating and low permeability coating used for coating polystyrene patterns used in the "EVAPORATIVE (LOST FOAM)" casting process.

STYROMOL 169 is the most widely used coating for thin section castings of 4 to 5 mm wall thickness. The low permeability controls metal velocity allowing controlled, regular filling of the pattern.

STYROMOL 169 is manufactured to strict quality standards, basic properties including the following:

- Will not attack polystyrene
- Wets the pattern
- Good dipping or overpouring rheology
- No syneresis
- Dried layer is tough and adhering
- Dried layer free from defects The metal used for a one-body cast metal wood is aluminum alloy A380, 383 or 384, density 2.740 g/c.c (0.0981b/in$^3$), liquidus temperature 595° C., solidus temperature 540° C.

Silicon oxide sand particles used range in size form 50 to 70 GFN (grain fineness number).

In this regard, the catalyst may be added to the binder-sand mixture just before the mix is blown into the hollow.

Figure 5:
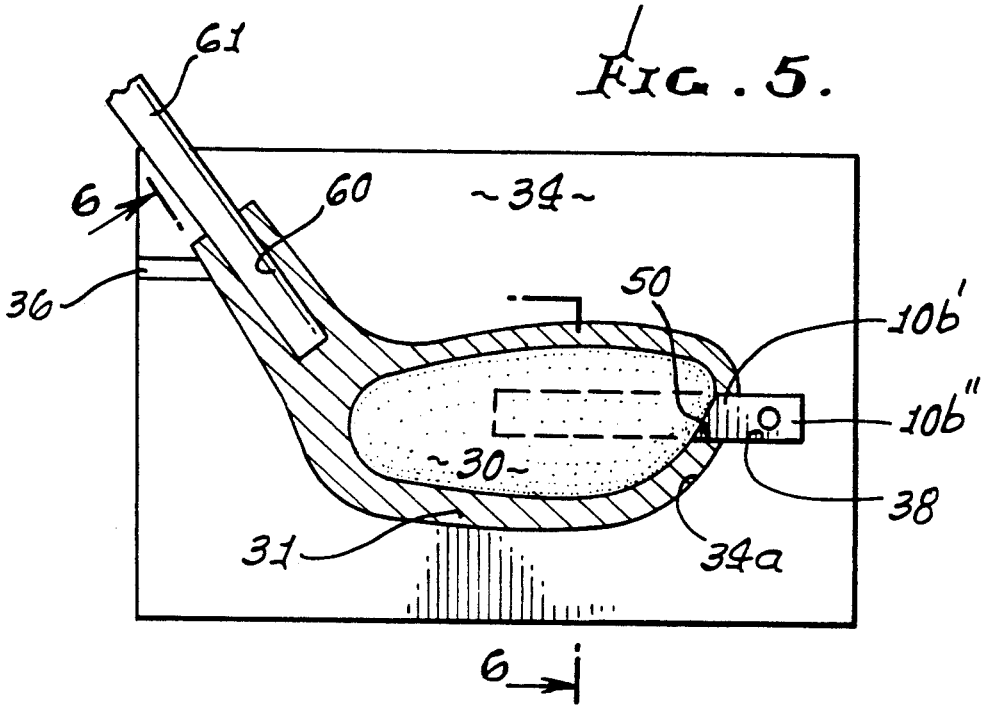
FIG. 5 is a toe to heel section taken on lines 5—5 of FIG. 6, through a casting mold section, to show the position of a sand core and arbor therein.
Figure 6:
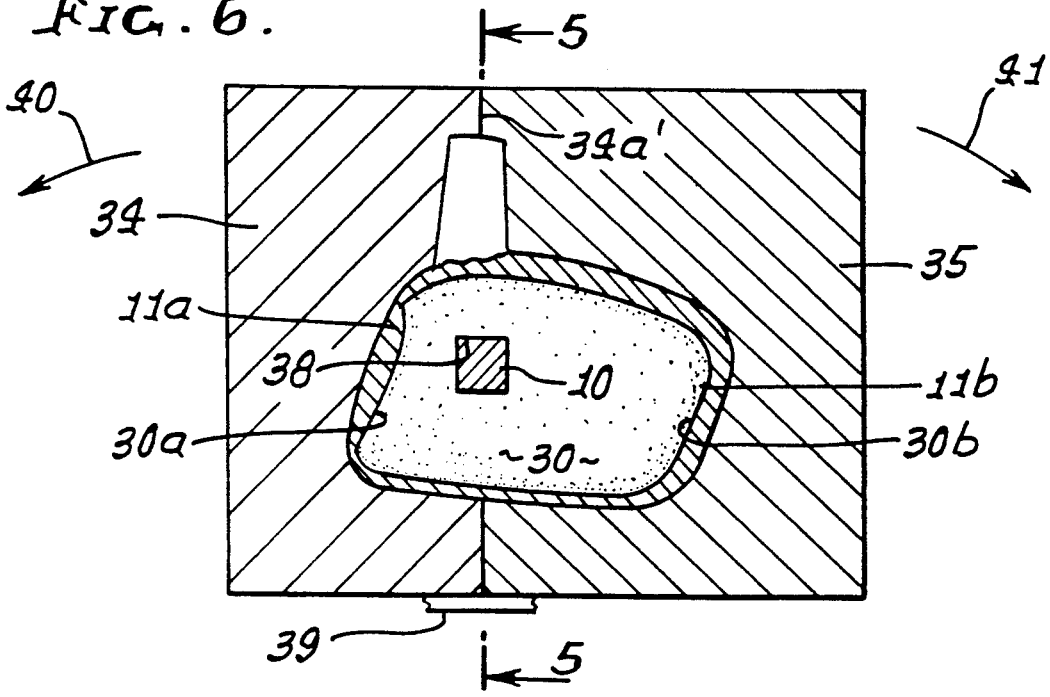
FIG. 6 is a section taken on lines 6—6 of FIG. 5.

FIGS. 5 and 6 show the hardened core 30 placed in a hollow 31 formed by casting mold sections 34 and 35. Casting metal may be introduced, via a port 36 in mold section 34. Liquid metal flows about the core and about the arbor section 10*b'* between the surface of the core and the mold inner wall 34*a*. Note support of the arbor external extent 10*b''* in a recess 38 in mold section 34, to position the core in the cavity. Mold sections are held together at 39. After hardening of the metal, the mold sections are separated (see arrows 40 and 41 in FIG. 6) and the exposed core and arbor are removed from section 34. Note that the arbor extent 10*b''* may be lifted sidewise from recess 38 which opens to the now exposed side 34*a* of mold section 34. The arbor may then be pulled free of the core, in the direction of the arbor length; and thereafter the core may be removed from the interior formed metallic head, as by inserting a break-up tool into the core via opening 50 in the head (at the toe), and pouring the broken pieces of the core from the head, via that opening.

A hosel opening 60 is formed by the removable insert 61, about which casting metal flows. Opening 50 may be closed by plugging, at the toe.

Another specific example includes the following steps:

1) The surface coated core is placed into the casting die, prepared for one-body die cast wood head, in correct position, and the arbor locked with a pin.

2) The molten aluminum alloy, (356 or A356) at high temperature (about 650° C.–700° C.) and high pressure (about 200–250 psi) flows into the mold over the special sand core, which is coated as referred to to sustain its shape against the pressure.

3) The temperature of the sand core is raised rapidly from about 120° C. to about 500° C. because the highest temperature of the sand core is higher than the decomposition temperature of core binder. Finally, the core will break down into sandy fragments, and is easily cleaned up, i.e. removed via opening 50.

4) Finally, the small square opening 50 left on the toe of the one-body precision cast metal wood head is covered with a metal symbolic decoration as a medallion, or simply welded shut.

Advantages of the invention include:

1) Physical specifications of a wood head, such as loft angle, lie angle, face progression, face angle as well as weight distribution or the center of gravity can be pre-controlled.

2) One-body casting gives more rigid construction to create a more solid impact feeling when a gold ball is struck.

3) Continuously, by interchangeable marking inserts using in die cast, the face pattern or scoring, top marking, and sole marking can be pre-designed and are also easily changeable.

4) Traditionally, in stainless steel metal woods, all plates are welded to one body, while for aluminum metal woods plates are either welded or fixed by screws and epoxy. Now in one-body cast metal woods according to the present invention, the processes and labor for welding or fixing plates are eliminated.

I claim:

1. In the method of making a golf club head comprising a shell having a ball striking face, a top wall, a bottom wall, a rear wall, and toe and heel walls, the steps that include a) forming a head core consisting of a mixture of particles in a binder, b) providing a core arbor extending into the core at the toe of the core and also externally thereof, c) and casting molten lightweight metal about said core and about said arbor to form the shell walls, d) removing the core arbor from the core while the core is within the cast shell walls thereby to form an opening in the shell at said toe region of the head, removing the core from the head via said opening, and welding shut said opening.

2. The method of claim 1 including also providing mold sections about said core prior to said casting step, and causing at least one of the mold sections to extend about the arbor, externally of said core.

3. The method of claim 2 including preliminarily forming said core by providing core forming die sections, supporting said arbor on at least one of the core forming die sections, introducing said mixture about the arbor, within said die sections, and curing the mixture in the die sections, to harden the core.

4. The method of claim 3 including separating said die sections from the hardened core, and manipulating the arbor protruding from the core to locate the core within said casting mold sections.

5. The method of claim 2 including locating said arbor at a plane or planes defined by a parting line or lines between said casting mold sections.

6. The method of claim 3 including locating said arbor at a plane or planes defined by a parting line or lines between said core forming die sections.

7. The method of claim 1 wherein said metal is aluminum.

8. The method of claim 4 wherein said metal is aluminum.

9. The method of claim 4 including applying a molten metal resistant coating to the core prior to said locating of the core within the casting mold sections.

* * * * *